US006988847B2

(12) United States Patent
Lazar

(10) Patent No.: US 6,988,847 B2
(45) Date of Patent: Jan. 24, 2006

(54) PAVING UNIT

(76) Inventor: Michael Lazar, Block 214 Marsiling Lane #24-806, Singapore (SG) 730214

( * ) Notice: Subject to any disclaimer, the term of this patent is extended or adjusted under 35 U.S.C. 154(b) by 0 days.

(21) Appl. No.: 10/482,863

(22) PCT Filed: Jul. 6, 2001

(86) PCT No.: PCT/SG01/00142

§ 371 (c)(1),
(2), (4) Date: Jan. 5, 2004

(87) PCT Pub. No.: WO03/004773

PCT Pub. Date: Jan. 16, 2003

(65) Prior Publication Data

US 2004/0161298 A1 Aug. 19, 2004

(51) Int. Cl.
*E01C 5/00* (2006.01)

(52) U.S. Cl. ..... 404/39; 404/34; 404/41; 52/603; 52/605

(58) Field of Classification Search ..... 404/34, 404/39, 41; 52/598, 603, 605; D25/113
See application file for complete search history.

(56) References Cited

U.S. PATENT DOCUMENTS

| | | | | | |
|---|---|---|---|---|---|
| 1,045,328 | A | * | 11/1912 | Sammis | 404/41 |
| 1,812,711 | A | * | 6/1931 | Pessione | 404/42 |
| 2,605,681 | A | * | 8/1952 | Trief | 404/41 |
| 3,229,439 | A | * | 1/1966 | Strobel | 52/591.2 |
| 3,522,618 | A | * | 8/1970 | Stranzinger | 14/27 |
| 3,873,225 | A | * | 3/1975 | Jakobsen et al. | 404/41 |
| D262,742 | S | * | 1/1982 | Vesterholt | D25/113 |
| 5,052,158 | A | * | 10/1991 | D'Luzansky | 52/177 |
| 5,503,498 | A | * | 4/1996 | Scheiwiller | 404/34 |
| 6,471,440 | B1 | * | 10/2002 | Scheiwiller | 404/39 |
| 6,863,469 | B2 | * | 3/2005 | Bolduc et al. | 404/41 |

FOREIGN PATENT DOCUMENTS

| | | | |
|---|---|---|---|
| DE | 26 38 905 | * | 3/1977 |
| DE | 26 34 586 | * | 9/1977 |
| DE | 296 04 736 | * | 7/1996 |
| FR | 1.009.462 | * | 5/1952 |
| GB | 1379825 | * | 10/1971 |
| GB | 2307260 | * | 5/1997 |
| JP | 8-199502 | * | 8/1996 |
| JP | 10-195843 | * | 7/1998 |

* cited by examiner

*Primary Examiner*—Gary S. Hartmann
(74) *Attorney, Agent, or Firm*—Birch, Stewart, Kolasch & Birch, LLP

(57) ABSTRACT

A interlocking paving unit has a top surface (2) and a plurality of side surfaces (4, 5), with at least one of the side surfaces (4, 5) of the paving unit being provided with at least one substantially vertically extending, substantially asymmetric protrusion (10). The protrusion (10) comprises a first ridge portion (11) and a second portion (12) being spaced apart by an intermediate portion (13). The protrusion (10) is locatable in a complementary recess on an adjacent paving unit, wherein the interengagement between the protrusion and the recess provides interlock between the paving unit and an adjacent paving unit.

20 Claims, 10 Drawing Sheets

Note: Mat like structure can accommodate extensive deformation or ground settlement Creeping of pavers Rotation of pavers

PAVING UNIT

FIELD OF THE INVENTION

The present invention is directed to improvements in or relating to paving units. More particularly the present invention relates to paving units having the capability of forming an integral structural surface.

BACKGROUND OF THE INVENTION

In this specification, where a document, act or item of knowledge is referred to or discussed, this reference or discussion is not an admission that the document, act or item of knowledge or any combination thereof was at the priority date:

(i) part of common general knowledge; or (ii) known to be relevant to an attempt to solve any problem with which this specification is concerned.

Whilst the following discussion concerns paving units, their installation and manufacture, in particular, paving units capable of interlocking with adjacent paving units, it is to be understood that the same principles apply to paving units of any shape or colour.

Small element paving comprises a plurality of paving units arranged together to provide a paved surface. Over the last thirty years small element paving has developed from its initial use as a surface for footpaths and other light duty applications to use as an integral structural surface for heavy duty pavements. Heavy duty pavements are used for example at ports, trucking stations, on roads, at bus stops and at airports.

Such structures must be resistant to the movement of individual paving units relative to one another. If a paving unit is separated from its adjacent paving unit, whether it be due to subsidence of the ground on which the paving unit is laid or to a breakdown in the connection between adjacent paving units, it is likely to present a gap or an otherwise uneven surface.

It will be apparent that that is a potentially dangerous situation, as a pedestrian may catch a heel or the toe of a shoe in the gap created, and may trip and fall. Depending on the width of the gap, it may also have adverse consequences for the tyres and wheels and hence the suspension system of trucks and aircraft, and may lead to a catastrophic outcome if any of those elements was to fail.

A dislodged paving unit may also pose a risk to the turbines of aircraft engines if a loose paving unit was drawn into the engine.

Standard paving units have proved to be inefficient as they do not inherently have sufficient 'interlock'.

The concept of interlock relates to the ability of an individual paving unit to articulate independently of an adjacent unit without being dislodged from the overall paving structure.

Three forms of interlock should ideally be present in a block paving system, namely:

- rotational interlock, which is achieved by the presence of edge restraints.
- vertical interlock, which is provided by the presence of stable compacted sand between all adjacent units.
- horizontal interlock, which is achieved by a combination of laying paving units in a herringbone pattern and by the use of shaped units.

These forms of interlock are intended to prevent paving units from 'creeping', that is, moving horizontally when a force is applied to the paving unit in a direction which is not perpendicular to an upper face of the unit. It is also intended to resist rotational and vertical movement relative to an adjacent unit.

Small element paving units rely on the continuous presence of compacted sand between individual paving units to provide the necessary 'interlock' to resist horizontal, vertical and/or rotational displacement of the paving unit. This sand also inhibits ingress of water into the underlying pavement structure. Displacement may manifest itself when a substantial weight is repeatedly placed on an individual unit by, for example, continuous trafficking over an individual unit.

Further displacement can occur as a result of changes in the underlying substratum on which the paving is laid.

Unfortunately, the sand which provides the interlock between the adjacent paving units can, over a period of time, be displaced from the joints by various agents of erosion such as jet blast, use of vacuum sweepers, water flow, and degradation and liquefaction of laying course materials, thereby resulting in a loss of interlock.

The loss of sand in the joints negates the interlock which can lead to serious deformation and eventual disintegration of the paving surface as shown in FIGS. 8 to 13.

Earlier attempts to provide further interlock between individual paving units consisted of designing various shapes to increase interlock. This included E-shaped, Y-shaped and L-shaped paving units with a plurality of engagement points for adjacent paving units.

Although these various shapes have been tested, it has been observed that problems still persist as shaped paving units may not provide sufficient interlock for use as part of heavy duty pavements. These paving units are also costly to manufacture and time consuming to lay given their often convoluted design.

Other attempts to provide suitable heavy duty pavements include the adoption of a mechanical locking device involving complementary recesses and protrusions on adjacent paving units. This feature provided a further degree of interlock between adjacent paving units.

However, whilst an apparent improvement, "self-locking" paving units do not readily resist vertical or horizontal movements. The paving units can also be rotated and become uneven should there be a slight deformation in the overall pavement either by external pressure or by changes in the underlying ground. Hence these are consequently unsuitable for heavy duty pavements with constant traffic.

Similarly, these paving units are also unsuitable for airports as jet aircraft engines can provide a suction effect that can result in the displacement of the individual paving units.

SUMMARY OF THE INVENTION

The present invention accordingly provides in one embodiment a paving unit for use as part of a paving arrangement, the paving unit having a top surface and a plurality of side surfaces with one of the side surfaces of the paving unit being provided with at least one substantially asymmetric vertically extending tongue when the paving unit is in an as laid form, the tongue comprising a ridge portion and a substantially tapering second portion, the ridge portion and the tapering portion being spaced apart by a substantially planar intermediate portion, the tongue capable of engaging a complementary groove in an adjacent paving unit, the groove only being open to the extent that the groove permits the tongue to be inserted into and enclosed within the groove, wherein the interengagement between the tongue and the groove provides interlock between the paving unit and an adjacent paving unit.

The paving unit according to the invention has been found to provide a degree of interlock to reduce the incidence of vertical and rotational movement of the paving unit. The interlock is enhanced by the dimensions of the protrusion/complementary recess and the engagement therein.

The tapering may be towards or away from a side surface of the paving unit. Preferably the second portion tapers in the direction of a side surface of the paving unit.

An outer surface of the intermediate portion typically extends in a direction which is substantially parallel to a side surface of the paving unit.

The top surface of the paving unit can take any suitable shape. Preferably the top surface of adjacent paving units is of substantially similar configuration. Preferably the top surface is substantially planar. The top surface may be of a substantially rectangular configuration. It may be of substantially square configuration. It may be of another polygonal configuration, such as a hexagon. Other top surface shapes are envisaged within the scope of the invention.

In a typical preferred configuration, a paving unit according to the invention has on opposed side surfaces at least one protrusion as described and at least one complementary recess to receive a protrusion as described.

In an alternative arrangement within the scope of the invention, opposed side surfaces may both carry protrusions. In another alternative arrangement, the opposed sides may carry complementary recess(es). Alternatively, opposed sides may have a combination of protrusions and recesses. In these preferred embodiments, adjacent paving units will have either protrusions, complementary recesses or a suitable combination to allow for interengagement and interlock.

A paving unit according to the invention having a substantially rectangular configuration will typically have on its opposed shorter side surfaces at least one protrusion and at least one complementary recess. Alternatively, opposed shorter side surfaces may both have protrusions. Alternatively, opposed shorter side surfaces may have complementary recesses. Alternatively, opposed shorter side surfaces may have a combination of protrusions and recesses. In the latter embodiments, adjacent paving units will of course have either protrusions, complementary recesses or a suitable combination to allow for interengagement and interlock with adjacent paving units.

According to a further preferred form of the invention, the paving units may be manufactured in a wide range of colours. Preferably the top surface of the paving unit will include an at least partly reflective surface. The reflective surface may take any suitable form. It will typically be integral with the top surface of the paving unit, although it may be provided by the application of a composite mix to the surface. The reflective surface may be formed by the application of a reflective mix.

According to a further preferred form of the invention, the paving units may include a noise reducing agent. The noise reducing agent may take any suitable form. Preferably the noise reducing agent is provided in part by chamfering edges of the paving unit.

The present invention provides in another embodiment a pavement comprising an array of paving units as described above interlocked by said tongue and groove arrangement to form a substantially continuous pavement.

The pavement will typically be constructed by fitting paving units with complementary side surfaces adjacent to one another, such as side by side with one another or end to end. Side surfaces of the paving units can as described herein include various combinations of protrusions and complementary recesses arranged to interengage adjacent paving units, thereby providing an interlocked pavement.

A pavement according to the invention may take any suitable form. Preferably the paving units are of a substantially rectangular configuration. The paving units may be arranged in a herringbone configuration to enhance the degree of interlock. Other pavement configurations are envisaged within the scope of the invention.

The present invention provides in another embodiment a method for laying a multiplicity of paving unit as described above, the method comprising the step of interlocking in a final laying pattern said multiplicity of paving units to form a pallet, and mechanically laying the paving units by securing and placing the whole layer onto the prepared base.

The method may further include the step of interengaging edges of adjacent layers during a mechanical laying step to form a pavement.

Layers can subsequently engage adjacent layers with the paving units of one layer interengaging the protrusions or recesses of paving units of the adjacent layer. In this way a continuous pavement can be rapidly laid. The interlock provided by the interengagement of protrusions and complementary recesses is also intended to reduce the incidence of paving units becoming dislodged during a pallet forming operation.

DESCRIPTION OF THE DRAWINGS

The invention will now be further explained and illustrated by reference to the accompanying drawings in which.

Turning to the drawings, a paving unit 1 includes a top surface 2 and a plurality of side surfaces 3, 4, 5 and 6. In this preferred embodiment, the top surface 2 is of a substantially rectangular prism configuration although other configurations are envisaged within the scope of the invention. As a consequence of its rectangular configuration, the paving unit 1 has opposed longer side surfaces 3 and 4 and opposed shorter side surfaces 5 and 6.

Figure 2:
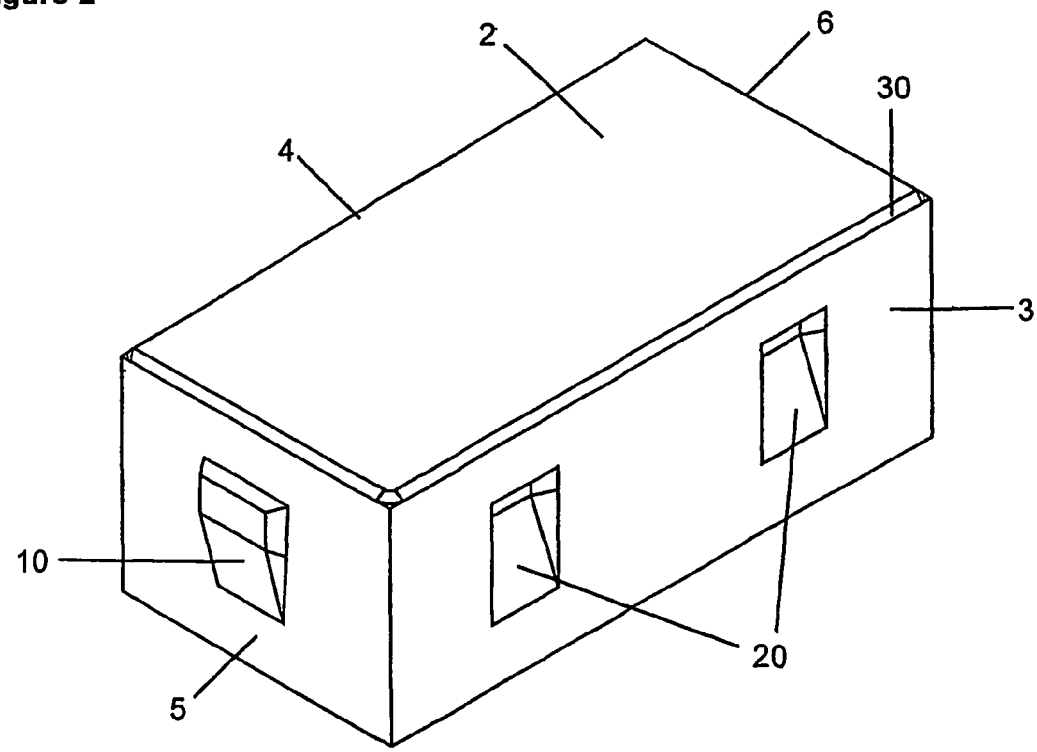
Figure 3:
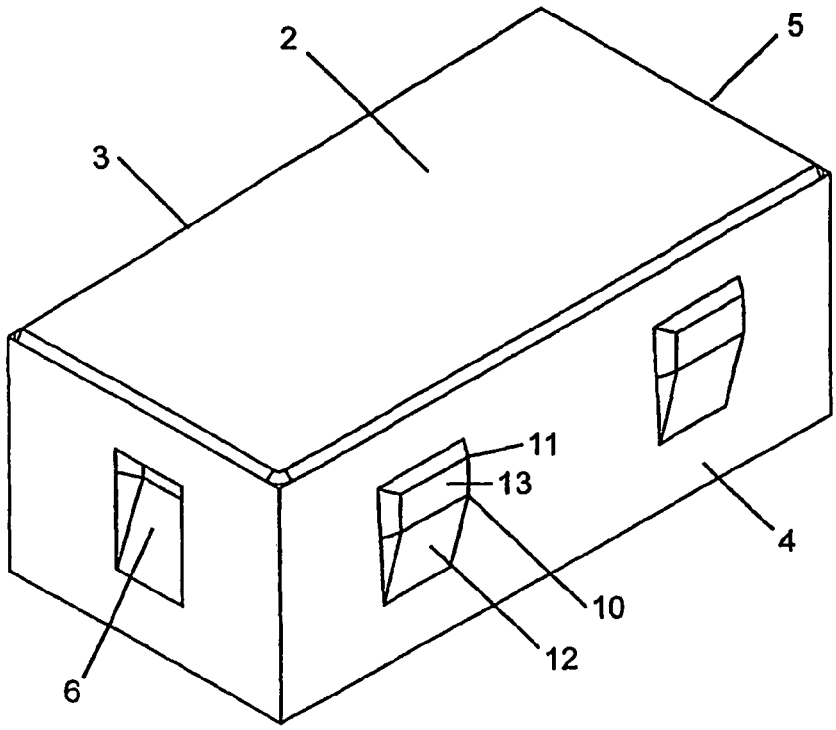
Figure 4:
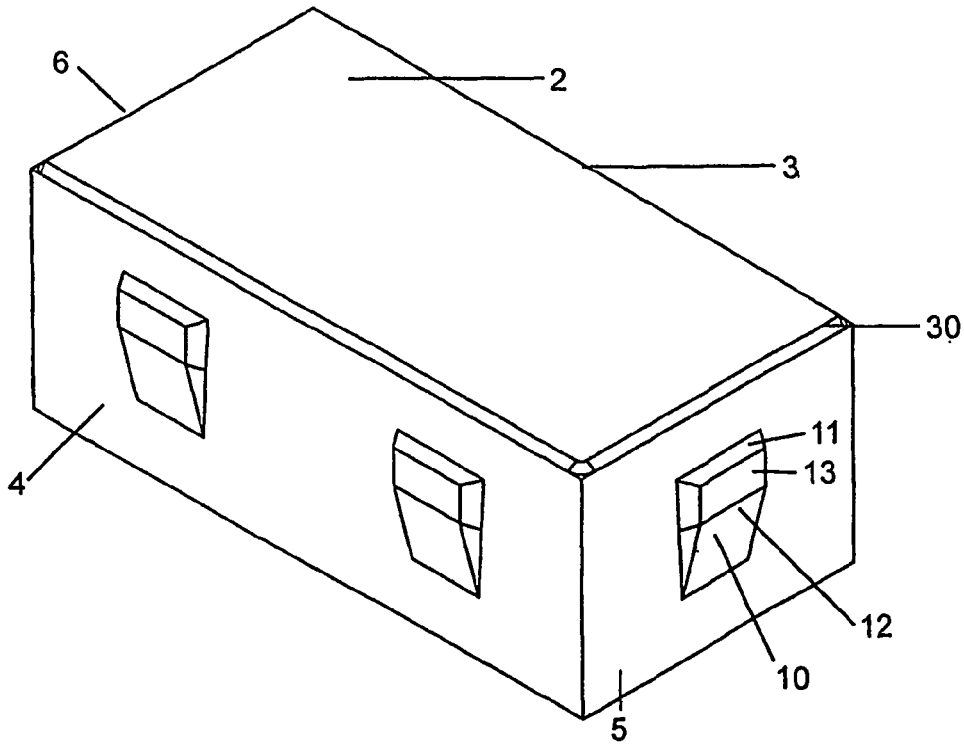

As is shown in FIGS. 3 and 4, a longer side surface 3 has a pair of asymmetric protrusions 10. Each protrusion extends substantially vertically from side surface 3 and tapers outwards from the side surface. Each protrusion includes a ridge portion 11 and a second portion 12, ridge portion 11 and second portion 12 being spaced apart by an intermediate portion 13. As is shown in FIGS. 2 and 4 a protrusion 10 is also located on a shorter side surface 5.

Figure 1:
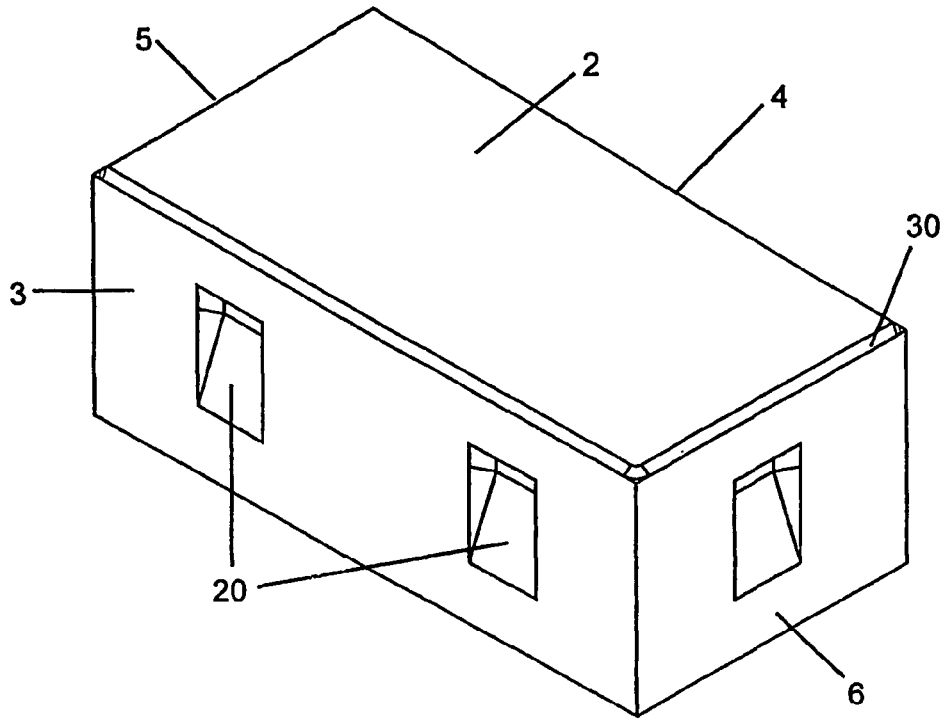
FIGS. 1 to 4 are perspective views of a paving unit according to one embodiment of the present invention.

As shown in FIGS. 1 and 2, the remaining longer side surface 4 has a pair of complementary recesses 20. The dimensions of the recesses 20 correspond to the extended dimensions of the protrusions 10. Consequently, a protrusion 10 of an adjacent paving unit may be located within the recess 20. The dimensions of the protrusions 10 and complementary recesses 20 and the interengagement between them provides interlock between adjacent paving units to reduce the incidence vertical and rotational movement.

As is shown in FIGS. 1 to 4, second portion 12 tapers towards the side surface of the paving unit 1. The intermediate portion 13 is in the embodiment shown substantially planar, with an outer surface extending approximately parallel to the side surface to give the appearance of a tongue like projection. The corresponding recesses can be conveniently considered as a complementary groove.

Figure 14:
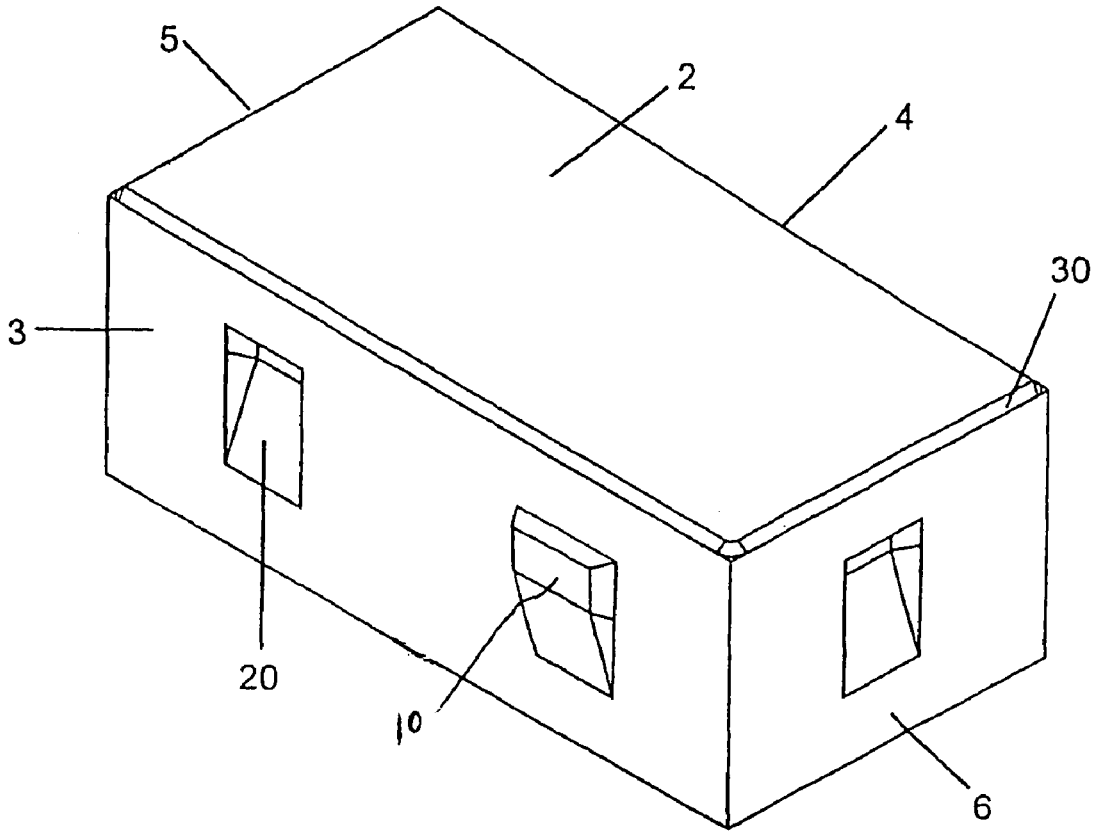
FIG. 14 is a perspective view of a paving unit according to another embodiment of the present invention.

FIG. 14 shows another embodiment of the paving unit, which is similar to the embodiment shown in FIG. 1, except that each longer side surface 3 contains one protrusion 10 and one complementary recess 20.

The paving unit 1 may be manufactured in a wide range of colours. The top surface 2 may include an integral reflective surface (not shown). The paving units may also include a noise reducing agent. As shown in FIGS. 1 to 4, the top edges 30 of the paving unit 1 are chamfered edges of the paving unit.

Figure 5:
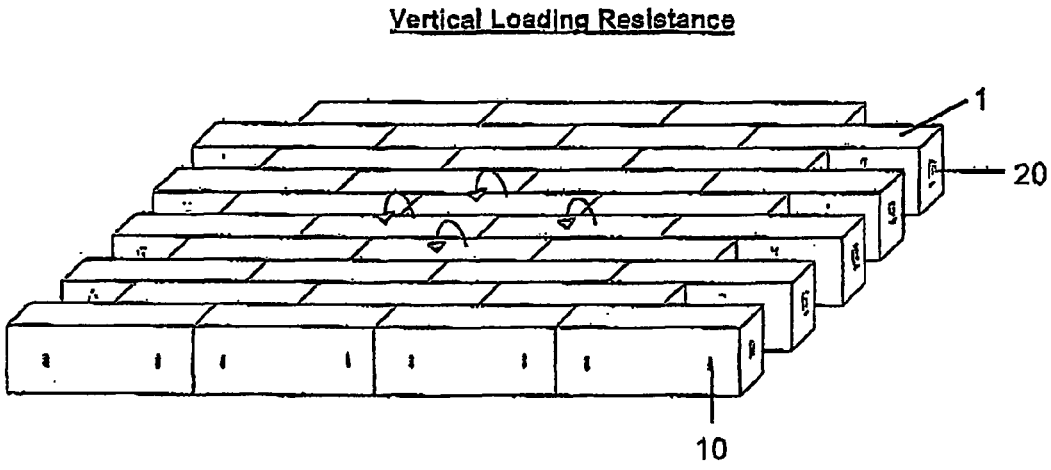
FIG. 5 is a side view of the paving unit of FIGS. 1 to 4 arranged as part of a pavement.
Figure 6:
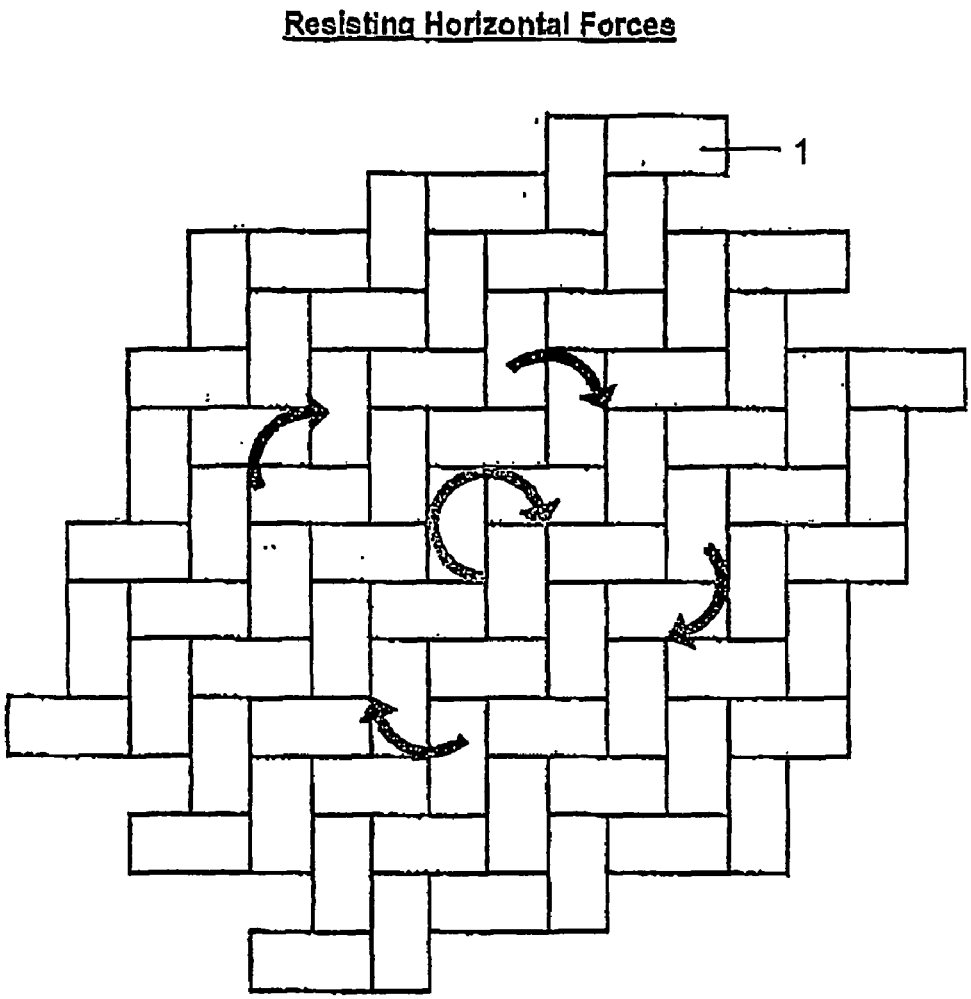
FIG. 6 is a plan view of the pavement of FIG. 5.
Figure 7:
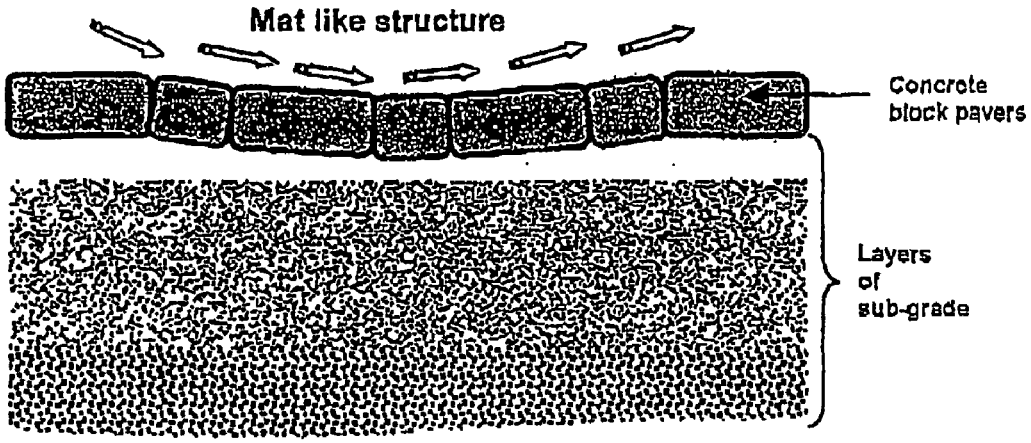
FIG. 7 is a cross sectional view of the pavement of FIG. 5.
Figure 8:
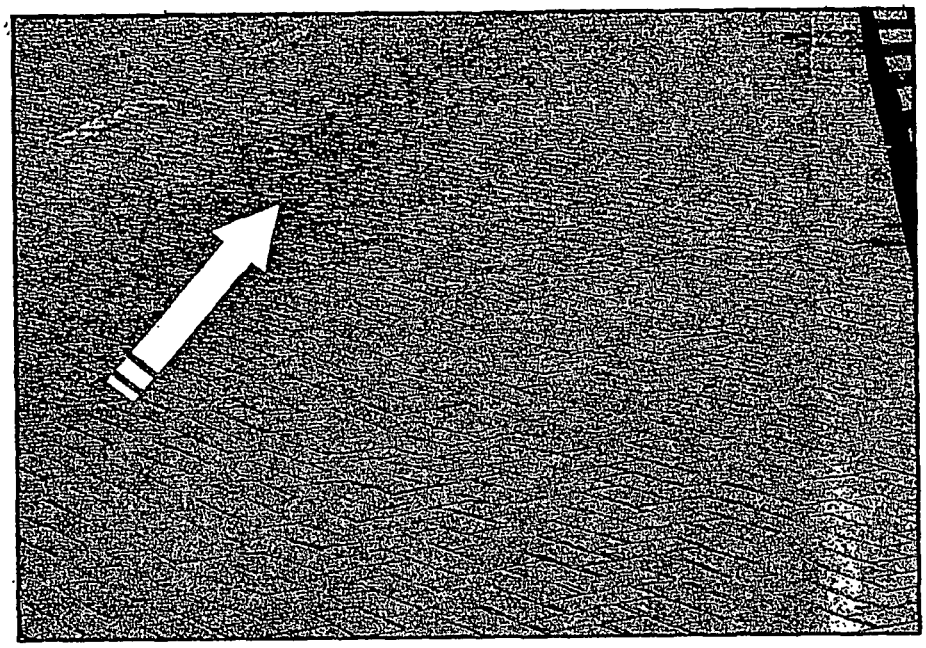
FIGS. 8 to 13 are examples of problems associated with standard paving units of the prior art.
Figure 9:
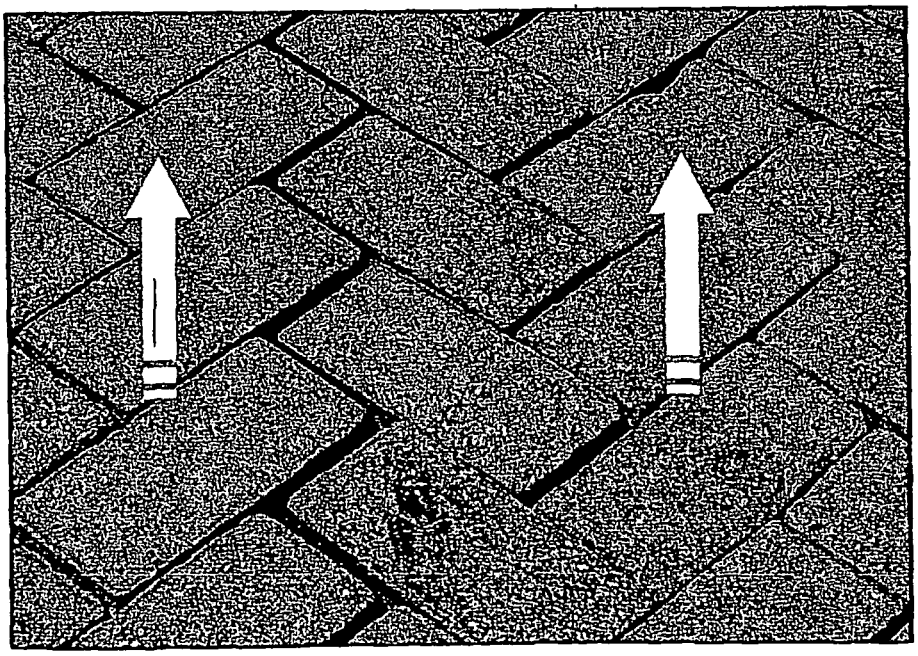
Figure 10:
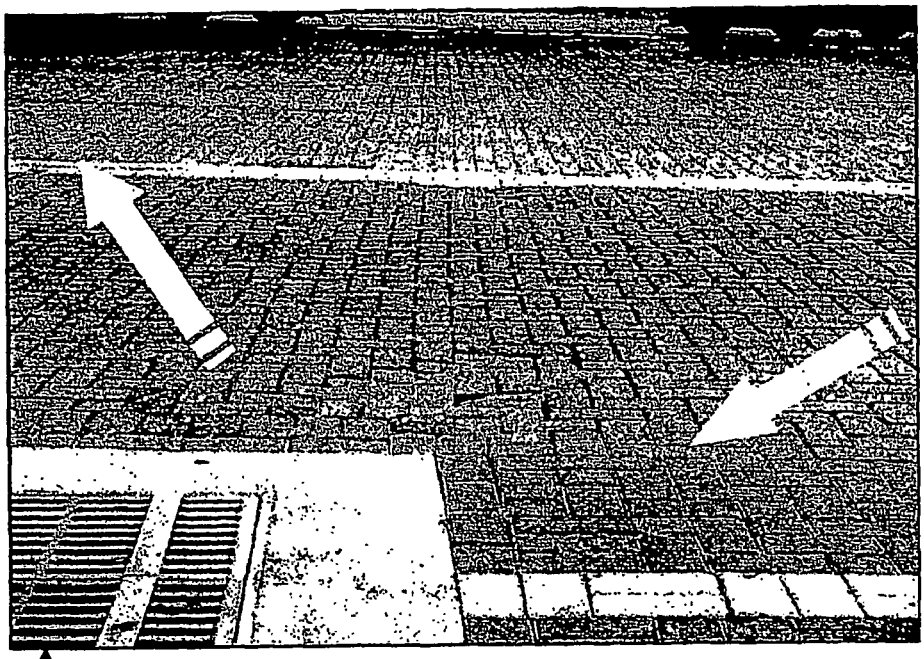
Figure 11:
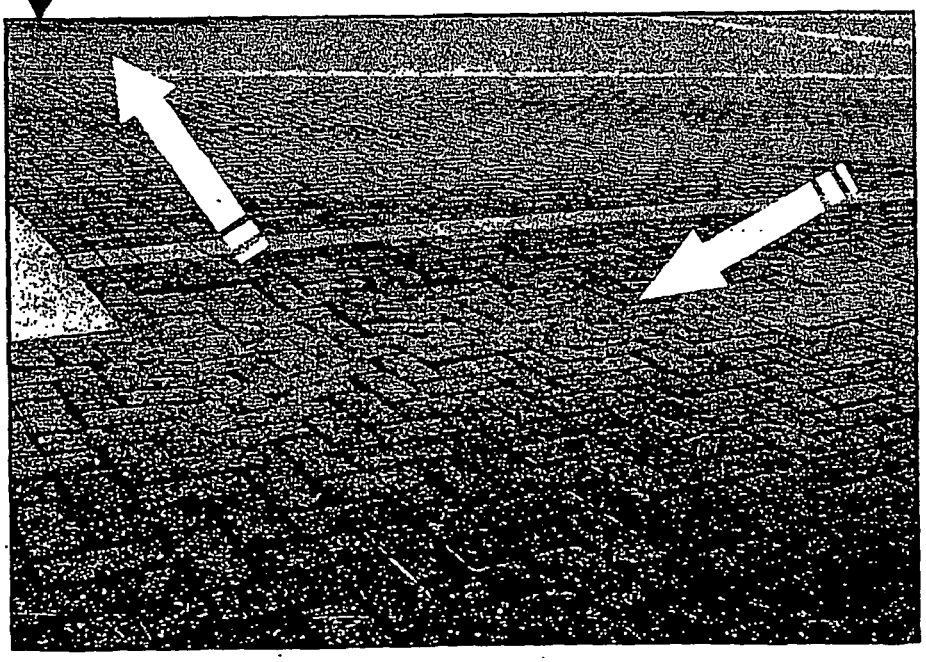
Figure 12:
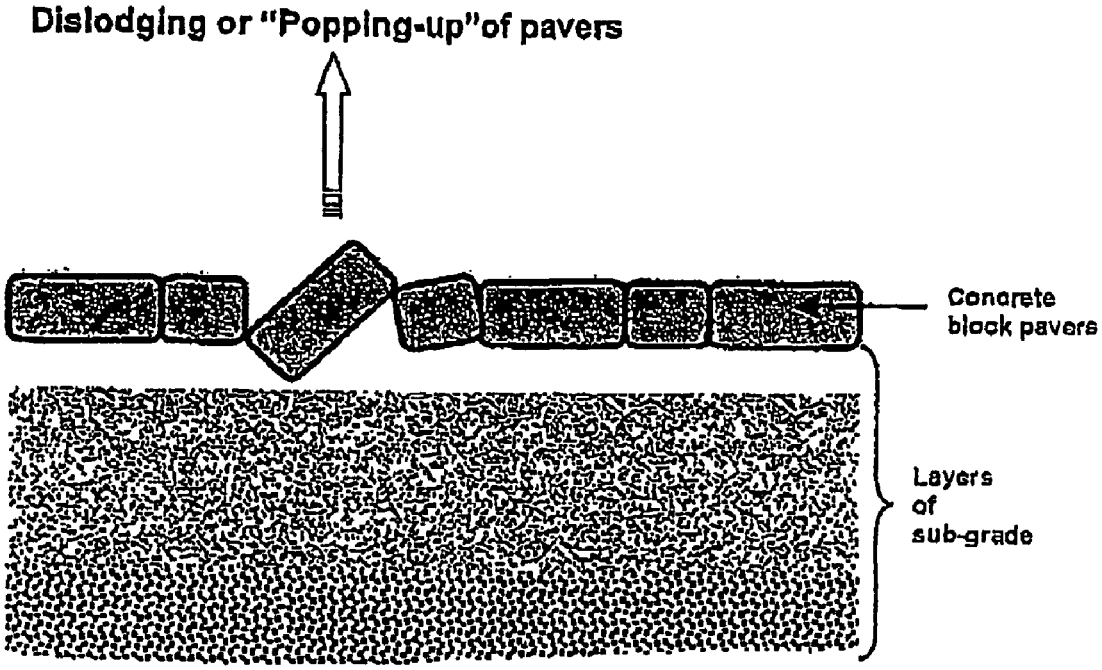
Figure 13:
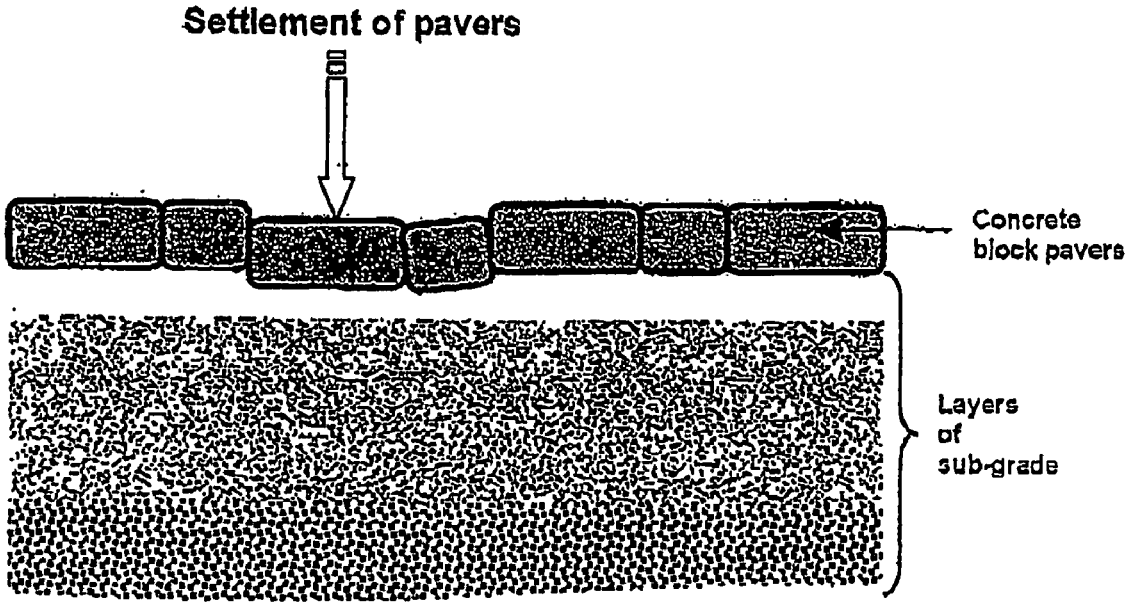

As shown in FIGS. 5 and 6 a plurality of paving units 1 can be arranged to form a pavement by fitting paving units 1 with complementary side surfaces to allow for inter engagement and provide a degree of interlock. As is shown in FIG. 6, the paving units can be arranged in a herringbone arrangement to maximize inter lock. As is shown in FIG. 12 the pavement results in a mat like structure to accommodate for substantial deformation or ground settlement.

A multiplicity of paving 1 can be interlocked in a final laying pattern to form a pallet, whereby to facilitate mechanical laying of the pallet. Pallets can subsequently engage adjacent pallets with the paving units of one pallet interengaging the protrusion 10 or recesses 20 of paving units 1 of the adjacent pallet. In this way a continuous pavement can be rapidly laid. The interlock provided by the interengagement of protrusions and complementary recesses is also intended to reduce the incidence of paving units becoming dislodged during a pallet forming operation.

The word 'comprising' and forms of the word 'comprising' as used in this description and in the claims does not limit the invention claimed to exclude any variants or additions. Modifications and improvements to the invention will be readily apparent to those skilled in the art. Such modifications and improvements are intended to be within the scope of this invention.

The claims defining the invention are as follows:

1. A paving unit for use as part of a paving arrangement, the paving unit comprising:

a top surface and a plurality of side surfaces with one of the side surfaces of the paving unit provided with at least one substantially asymmetric vertically extending tongue and at least one substantially asymmetric vertically extending recessed groove when the paving unit is in an as laid form, the tongue including a ridge portion and a substantially tapering second portion, the ridge portion and the tapering portion being spaced apart by a substantially planar intermediate portion, the tongue capable of engaging a complementary groove in first adjacent paving unit, wherein said ridge portion, and the recessed groove only opening into a side surface of said paving unit to the extent that the recessed groove permits a complementary tongue on a second adjacent paving unit to be inserted into and enclosed within the recessed groove, wherein the interengagement between the tongue on the second adjacent paving unit and the recessed groove provides interlock between the paving unit and all adjacent paving units.

2. The paving unit according to claim 1 wherein the tongue is tapered.

3. The paving unit according to claim 2 wherein the tongue tapers towards a side surface of the paving unit.

4. The paving unit according to claim 1 wherein the second portion tapers towards a side surface of the paving unit.

5. The paving unit according to claim 1 wherein the intermediate portion extends in a direction which is substantially parallel to a side surface of the paving unit.

6. The paving unit according to claim 1 wherein the top surface of the paving unit is of substantially similar configuration as an adjacent paving unit.

7. The paving unit according to claim 1 wherein the top surface is of a substantially rectangular configurations.

8. The paving unit according to claim 1 wherein the paving unit has on opposed side surfaces at least one tongue and at least one complementary groove to receive a protrusion.

9. The paving unit according to claim 1 wherein opposed side surfaces both carry tongues.

10. The paving unit according to claim 1, wherein opposed side surfaces both carry complementary grooves.

11. The paving unit according to claim 1 wherein opposed side surfaces both have a combination of tongues and grooves.

12. The paving unit according to claim 1 wherein the top surface of the paving unit includes an at least partly reflective surface.

13. The paving unit according to claim 12 wherein the reflective surface is provided by the application of an at least partially reflective layer to the top surface of the paving unit.

14. The paving unit according to claim 1 wherein the paving unit includes a noise reducing agent.

15. The paving unit according to claim 14 wherein the noise reducing agent is provided in part by chamfering the edges of the paving unit.

16. A pavement comprising an array of paving units according to claim 1, said paving units being interlocked by said groove and tongue arrangement to form a substantially congruous pavement.

17. The pavement according to claim 16 wherein the paving units are arranged with complementary side surfaces adjacent to one another.

18. The pavement according to claim 16 wherein the paving units are arranged in a herringbone pattern.

19. A method for laying a plurality of paving units as claimed in claim 1, the method comprising the step of interlocking said paving units in a final laying pattern to form a layer on a pallet and mechanically laying the layer.

20. The method according to claim 19, further including the step of interengaging edges of adjacent layers from the pallets during the mechanical laying step to form a pavement.

* * * * *